US006560868B2

(12) United States Patent
Milliff et al.

(10) Patent No.: US 6,560,868 B2
(45) Date of Patent: May 13, 2003

(54) METHOD OF MAKING LOWER END CAP FOR SCROLL COMPRESSOR

(75) Inventors: Tracy Milliff, Bristol, VA (US); John R. Williams, Bristol, VA (US)

(73) Assignee: Scroll Technologies, Arkadelphia, AR (US)

( * ) Notice: Subject to any disclaimer, the term of this patent is extended or adjusted under 35 U.S.C. 154(b) by 67 days.

(21) Appl. No.: 09/872,972

(22) Filed: Jun. 1, 2001

(65) Prior Publication Data

US 2002/0182092 A1 Dec. 5, 2002

Related U.S. Application Data

(63) Continuation-in-part of application No. 09/376,915, filed on Aug. 18, 1999, now Pat. No. 6,247,909.

(51) Int. Cl.[7] ..... B23P 15/00; F04C 18/04

(52) U.S. Cl. ..... 29/888.022; 29/888.02; 29/557; 418/55.1

(58) Field of Search ..... 29/888.02, 288.02, 29/428, 557; 418/55.1, 55.6, 94; 417/902; 184/6.16, 6.18

(56) References Cited

U.S. PATENT DOCUMENTS

| | | | | | |
|---|---|---|---|---|---|
| 1,964,415 | A | * | 6/1934 | Van Deventer | 417/356 |
| 2,628,765 | A | * | 2/1953 | Anderson | 417/362 |
| 4,585,403 | A | * | 4/1986 | Inaba et al. | 418/55.5 |
| 5,042,150 | A | * | 8/1991 | Fraser, Jr. | 29/464 |
| 5,098,265 | A | * | 3/1992 | Machida et al. | 418/55.2 |
| 5,232,355 | A | * | 8/1993 | Fujii et al. | 418/141 |
| 5,391,054 | A | * | 2/1995 | Bush | 220/DIG. 13 |
| 6,264,443 | B1 | * | 7/2001 | Barito | 29/888.022 |
| 6,280,154 | B1 | * | 8/2001 | Clendenin et al. | 417/410.5 |
| 6,280,155 | B1 | * | 8/2001 | Dreiman | 417/410.5 |

* cited by examiner

*Primary Examiner*—I. Cuda-Rosenbaum
(74) *Attorney, Agent, or Firm*—Carlson, Gaskey & Olds

(57) ABSTRACT

A lower end cap for a scroll compressor includes a plurality of generally u-shaped surfaces, wherein the u-shaped surfaces have circumferentially spaced gaps. The gaps provide a location for mounting a weld seam from the center shell. The gaps are preferably machined at an outer periphery to provide a guiding surface for the center shell.

3 Claims, 3 Drawing Sheets

METHOD OF MAKING LOWER END CAP FOR SCROLL COMPRESSOR

This application is a continuation-in-part of U.S. patent application Ser. No. 09/376,915, filed Aug. 18, 1999, U.S. Pat. No. 6,247,909.

BACKGROUND OF THE INVENTION

This application relates to features of a combined lower bearing mount and a lower housing end cap in a compressor. In particular, structure on the lower end cap facilitates the alignment housing of an outer shell housing on the lower end cap.

Scroll compressors are becoming widely utilized in refrigerant compression applications. In a scroll compressor, first and second scroll members each have a base and a generally spiral wrap extending from their bases. The wraps interfit to define compression chambers. One of the two scroll members is caused to orbit relative to the other, and with the orbital movement the size of the compression chambers decreases. An entrapped refrigerant is then compressed.

A shaft is driven by an electric motor, and operates through a connection to cause the scroll member to orbit. The shaft is mounted adjacent a lower end of the housing on an opposed side of the motor relative to the pump unit.

Typically, the lower bearing is mounted from a center shell housing, and extending radially inwardly. More recently it has been proposed to mount the bearing on an end cap which defines a lower end of a sealed housing. Typically the housing for the scroll compressors include a center shell extending generally along the rotational axis of the shaft and having upper and lower end caps.

In one known type of scroll compressor, the end cap has an upwardly extending generally u-shaped structure positioned slightly radially inward of the inner periphery of the center shell. The center shell is then welded to that end cap. The prior art has had this u-shaped structure extending around the entire circumference. With such a structure, there has sometimes been alignment difficulties with regard to aligning a seam which is found extending along the axial length of the center shell, and is part of the formation of the center shell. The seam creates a discontinuity at the weld joint between the shell and the lower end cap. Moreover, the center shell has typically been placed around the outer periphery of the u-shaped circumferentially extending portion, and the circumferentially extending portion has generally had a small angle to facilitate this connection.

SUMMARY OF THE INVENTION

In the disclosed embodiment of this invention, the lower end cap is formed with circumferentially discontinuous and spaced u-shaped portions. The spacing between these portions facilitates the alignment of the center shell on the lower end cap. Specifically, the gaps between the u-shaped portions provide a space to which the seam can be aligned. Moreover, in the present invention, the outer periphery of the spaced u-shaped portion is machined such that the center shell is positioned at a location spaced by an idealized distance from the location of a bearing. That is, with this invention the end cap can be ideally positioned relative to the center shell, and relative to a lower bearing mounted to the lower end cap. In this way, the alignment of components within the compressor is improved compared to the prior art. Various embodiments of the u-shaped section are disclosed.

These and other features of the present invention can be best understood from the following specification and drawings, the following of which is a brief description.

DETAILED DESCRIPTION OF A PREFERRED EMBODIMENT

Figure 1:
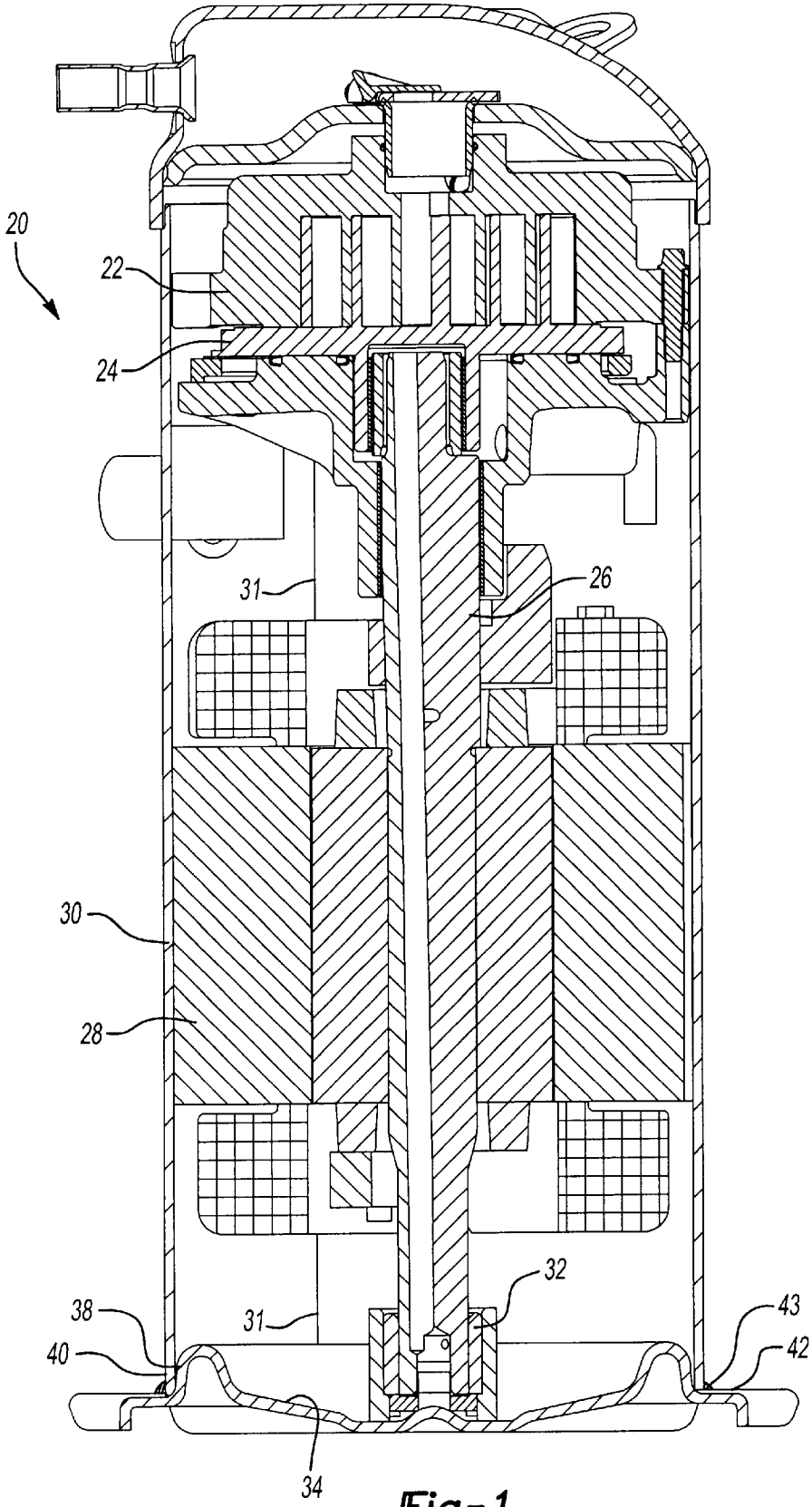
FIG. 1 is a cross-sectional view through an inventive scroll compressor.

FIG. 1 shows a scroll compressor 20 incorporating a non-orbiting scroll 22 and an orbiting scroll 24. As is known, the shaft 26 is driven to rotate by a motor 28. When the shaft 26 rotates it causes the orbiting scroll 24 to orbit in a manner well known in the art.

A housing for the compressor 20 incorporates a generally cylindrical center shell 30. As is shown schematically, shell 30 incorporates a seam 31. The seam 31 is formed when a sheet of material is rolled into the shell 30 and then welded.

A bearing 32 is welded to a lower end cap 34. Lower end cap 34 closes a side of the center shell 30 remote from the pump unit comprising the orbiting and non-orbiting scroll members 24 and 22. As shown, generally u-shaped structures 38 are formed at the outer periphery of the end cap 34, and receive a lower end 40 of the center shell 30. A flat surface 42 of the end cap 34 forms a location for a weld seam 43.

Figure 2:
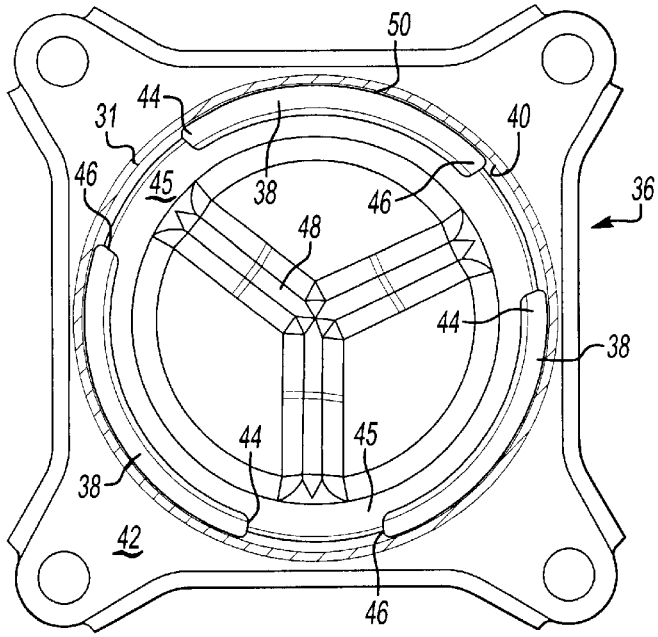
FIG. 2 is a plan view of a first embodiment housing end cap.

As shown in FIG. 2, the end cap 36 includes a plurality of u-shaped structures 38 which are spaced by areas 45 circumferentially intermediate opposed ends 44 and 46 of the u-shaped structures 38. Thus, with the present invention having the spaced unshaped structures the weld seam 31 can be aligned with a space 45, and the discontinuities that have been an issue in the prior art can be avoided.

Figure 3:
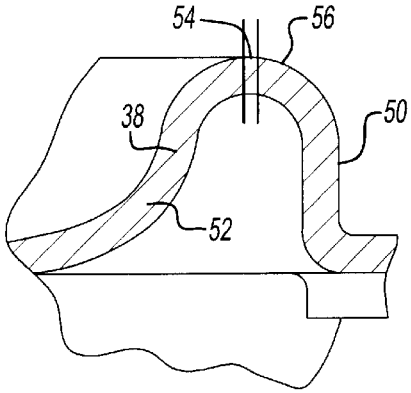
FIG. 3 is an enlarged cross-sectional view through a portion of FIG. 2 end cap.

As shown in FIG. 3, the surface of the structure 38 is preferably such that there is a generally cylindrical outer surface 50 which will receive the inner periphery of the lower end 40 of the center shell 30. U-shaped portions include an inner curved portion 52 merging into a very small flat 54, which in turn merges into an outer curve 56. With this surface, sufficient strength is provided into the u-shaped portion, while at the same time maintaining a good positioning structure for the lower end 40.

In the FIG. 2 embodiment, a plurality of crossing structures 48 serves to receive the lower end of the bearing 32. This aspect of the present invention is best disclosed in the above-referenced parent application.

Figure 4:
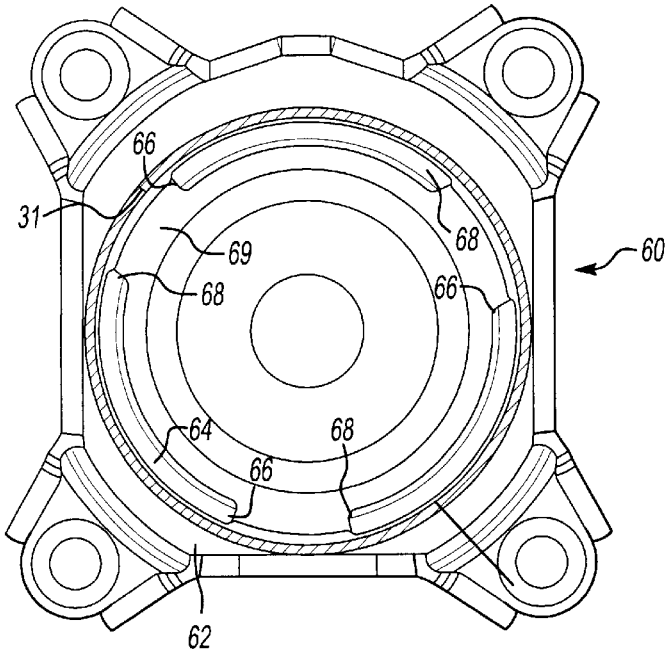
FIG. 4 shows another embodiment end cap.

As shown in FIG. 4, an alternative end cap embodiment 60 incorporates a flat surface 62 and a plurality of spaced u-shaped members 64 centered between ends 66 and 68. As with the prior embodiment, there are spaces 69 between the members 64, and these spaces can receive the seam 31 from the center shell lower end 40.

Figure 5:
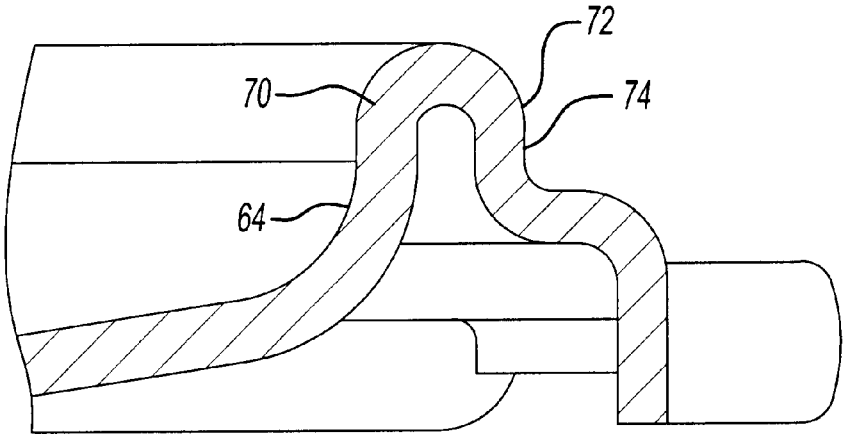
FIG. 5 is a cross-sectional view through the FIG. 4 end cap.

As shown in FIG. 5, in this embodiment, the u-shaped structure 64 has two generally curved surfaces 70 and 72 without the intermediate flat structure. Similar to the prior embodiment a generally cylindrical outer surface 74 is also provided.

Figure 6:
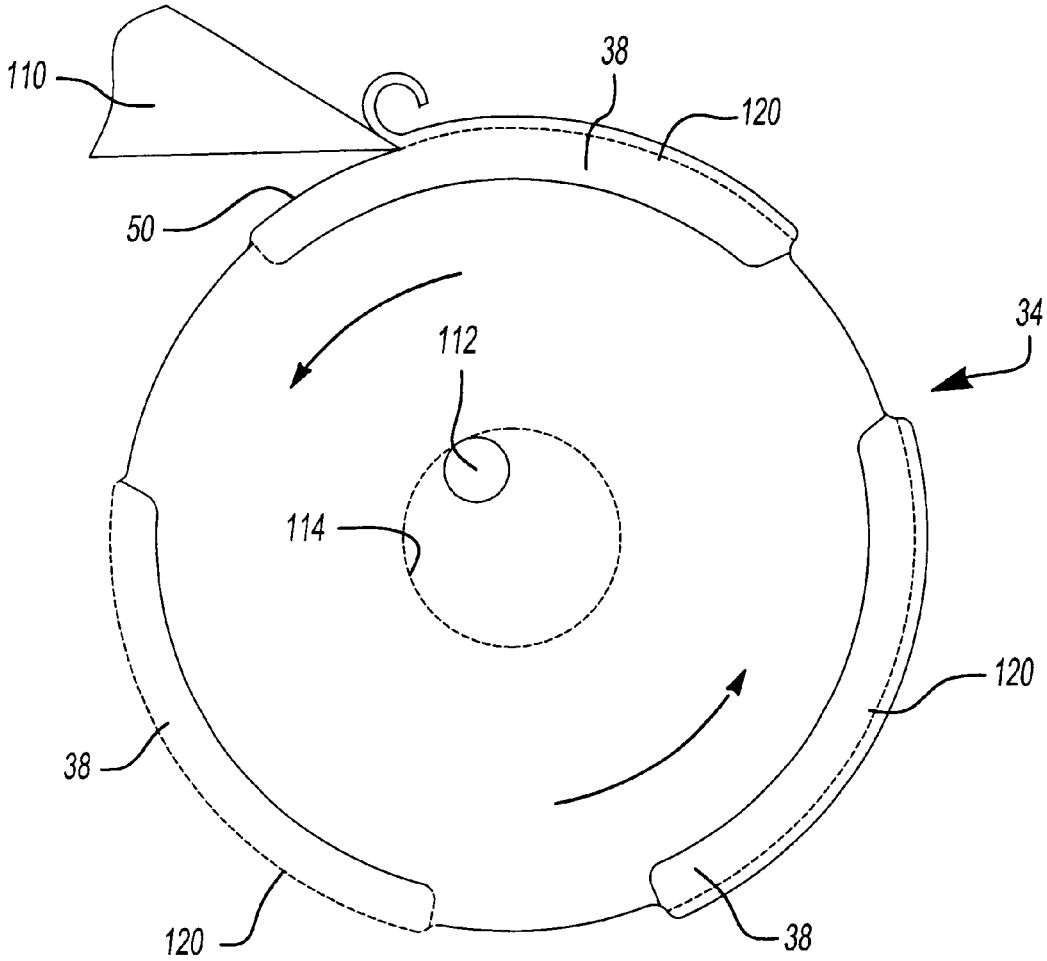
FIG. 6 schematically shows a machining operation according to the present invention.

With the present invention, the outer periphery of the u-shaped surfaces is cut away by a machine 110. This is illustrated schematically in FIG. 6. A second cutting tool 112 cuts the bearing bore 114 of lower bearing 32. Thus, the position of the outer surface 50 of the structure 38 is made to be identically co-centric and positioned relative to the bearing bore 114, and further is identically positioned with regard to the inner periphery of the center shell 30. In this way, the alignment of all portions of the scroll compressor 20 may be more easily ensured relative to each other. Thus, upon the formation of the lower end cap 34, there is initially material 120 shown in phantom, and greatly exaggerated for purposes of understanding the illustration, which is cut away. By cutting away the surfaces 120, the outer periphery 50 can be shaped as desired. As can be seen, the outer periphery 50 may be slightly radially outward from the nominal circular surface of the remainder of the lower end cap 34.

Preferably, and as illustrated, there are at least three of the u-shaped guiding surfaces. By having the plurality of gaps, Applicant has found that there is less tendency to twist across the end cap. While the FIG. 6 embodiment is shown with reference to the FIGS. 2 and 3 embodiment, it would have equal application in the FIGS. 4 and 5 embodiment. The use of the several u-shaped structural members would be several gaps ensures that the end cap would have adequate strength and rigidity, while at the same time providing the guiding and alignment features as described above.

While the above embodiments show the preferred method of stamping the end caps to include the u-shaped portions, it is also possible to have the shell OD stamped to be circular, and then have reliefs machined within that circular surface to form the circumferentially spaced u-shaped portions.

Although a preferred embodiment of this invention has been disclosed, a worker in this art would recognize that many modifications of this invention would come within the scope of this invention. For that reason the following claims should be studied to determine the true scope and content of this invention.

What is claimed is:

1. A method of providing an end cap into a lower end of a compressor comprising the steps of:

1) providing a center shell having a generally cylindrical inner surface, and providing a lower end cap having a plurality of circumferentially spaced guiding structural members, said guiding structural members being provided with an initial outer peripheral surface;

2) determining the desired location of a final outer peripheral surface of said guiding structure, and machining said outer peripheral surface of said initial guiding structure to reach said final outer peripheral surface; and 3) mounting said center shell onto said guiding structural members.

2. A method as recited in claim 1, wherein a scroll compressor pump unit is further positioned within said center shell.

3. A method as recited in claim 2, wherein a lower bearing member is mounted to said lower end cap, and said desired location of said final outer peripheral surface is defined in conjunction with a desired surface for a bearing bore in said lower bearing member to ensure concentricity between said bearing bore and said final outer peripheral surface.

* * * * *